US009700102B2

(12) United States Patent
McCleary et al.

(10) Patent No.: US 9,700,102 B2
(45) Date of Patent: Jul. 11, 2017

(54) CLASP AND SYSTEM

(71) Applicant: Tech Spark Innovations, LLC, Lincoln University, PA (US)

(72) Inventors: Timothy McCleary, West Grove, PA (US); William Hessler, Lincoln University, PA (US)

(73) Assignee: Tech Spark Innovations, LLC, Lincoln University, PA (US)

( * ) Notice: Subject to any disclaimer, the term of this patent is extended or adjusted under 35 U.S.C. 154(b) by 120 days.

(21) Appl. No.: 14/704,951

(22) Filed: May 5, 2015

(65) Prior Publication Data

US 2016/0324270 A1 Nov. 10, 2016

(51) Int. Cl.

| | |
|---|---|
| ***A43C 11/00*** | (2006.01) |
| ***A43C 1/04*** | (2006.01) |
| ***A43B 3/10*** | (2006.01) |
| ***A43B 3/12*** | (2006.01) |
| ***A43C 11/22*** | (2006.01) |

(52) U.S. Cl.

CPC ..... *A43C 11/008* (2013.01); *A43B 3/103* (2013.01); *A43B 3/105* (2013.01); *A43B 3/122* (2013.01); *A43B 3/126* (2013.01); *A43C 1/04* (2013.01); *A43C 11/22* (2013.01); *Y10T 24/2516* (2015.01)

(58) Field of Classification Search

CPC ..... A43C 11/008; A43C 1/04; A43C 11/22; Y10T 24/2516; A43B 3/103; A43B 3/122; A43B 3/126; A43B 3/105

See application file for complete search history.

(56) References Cited

U.S. PATENT DOCUMENTS

| | | | | | |
|---|---|---|---|---|---|
| 504,037 | A * | 8/1893 | Judson | A44B 19/36 | 2/218 |
| 1,408,563 | A * | 3/1922 | Conger | A43C 11/008 | 24/437 |
| 2,243,737 | A * | 5/1941 | Marinetti | A43C 11/008 | 24/439 |
| 2,814,085 | A | 11/1957 | Peselnick | | |
| 2,867,878 | A | 1/1959 | Sundback | | |
| 4,507,878 | A * | 4/1985 | Semouha | A43C 11/008 | 24/68 SK |
| 5,040,274 | A | 8/1991 | Keech | | |
| 8,590,121 | B1 | 11/2013 | Patt, Jr. | | |
| 2011/0258876 | A1* | 10/2011 | Baker | A43C 11/008 | 36/50.1 |
| 2011/0289742 | A1* | 12/2011 | Yen | A43C 1/04 | 24/68 SK |
| 2014/0325873 | A1* | 11/2014 | Linth | A43C 11/004 | 36/50.1 |
| 2015/0305432 | A1* | 10/2015 | Wiens | A43C 11/008 | 36/97 |
| 2016/0324271 | A1* | 11/2016 | McCleary | A43C 1/00 | |

* cited by examiner

*Primary Examiner* — Robert J Sandy
*Assistant Examiner* — Louis Mercado
(74) *Attorney, Agent, or Firm* — Da Vinci's Notebook, LLC

(57) ABSTRACT

A clasp is disclosed wherein two housings with fingers are interlocked in a transition fit and then secured by a central lock bar. The clasp is beneficially applied to open space between garment edges whereby the garment is fastened and sized.

19 Claims, 14 Drawing Sheets

CLASP AND SYSTEM

FIELD OF THE INVENTION

The present invention relates to the field of object joinery and more specifically to the field of positionable clasps.

BACKGROUND

For many years, laces have been used to help secure footwear, such as boots, shoes, skates and the like, onto the feet of the user. A typical boot includes first and second instep flaps that extend up the sides of the boot and are separated by a space. Usually, the flaps extend from a point close to the toe of the boot and extend rearwardly to the front surface of the ankle portion of the boot. Each of the first and second instep flaps includes or carries a series of eyelets adjacent the space between them. A single lace is generally interwoven into the eyelets. By threading a lace through the eyelets and pulling on the ends of the lace, the eyelets and the instep flaps can be pulled together in the space between them to thus tighten the flaps, and hence the boot, around the foot of a user. After the flaps are tightened, the ends of the lace are tied together to hold the boot on the foot of the user.

When the user wishes to remove his boot, the lace ends are untied, and the lace can be loosened, permitting loosening of the instep flaps, that is, increasing the space between the first and second flaps. This increased space between and the first and second flaps loosens the boot, thus permitting the user to remove it from his foot. One difficulty with footwear lacing systems is that it is often difficult to quickly tighten the footwear by pulling the flaps together with the lace and to maintain a tightened condition.

In many applications, it is desirable, if not essential, to secure a boot snugly onto the foot of a user. Two examples of such applications are with ice skates (including figure, speed, and hockey skates) and roller skates (both regular and in-line). With ice skates and roller skates, it is essential to have the boot of the ice skate fastened tightly around the ankle, so that the boot can provide ankle support to the user. This ankle support is necessary in order to ensure good skating performance. Additionally, in certain other applications, it is also essential to fasten a boot about a user's ankle tightly in order to give the user proper ankle support. Further, certain users, as a matter of individual preference, prefer to wear boots that are snugly secured to their feet, to provide appropriate ankle support.

Several known methods exist for tightly lacing a boot onto a foot. Typically, a boot lace is tightened by having the user start with one pair of the lower eyelets of the instep flaps of the boot and, using two hands (or fingers), to grip the lace adjacent a pair of eyelets and to pull the pair of eyelets toward with the lace to tighten the instep flaps at the particular pair of eyelets. The same procedure is then repeated with the next eyelet "up the boot" in toward the ankle while trying to maintain the tightened condition of the first pair of eyelets. This procedure is repeated until the lace has been tightened at each pair of eyelets. Upon reaching the last pair of eyelets the user then attempts to quickly tie the ends of the lace together and preserve the tightness of the lacing, before the instep flaps have had a chance to move apart through slippage between the lace and the eyelets.

This method has some drawbacks. First, it is difficult to pull the laces tightly at the eyelets. In addition, as the user attempts to tighten each pair of eyelets with the lace, the lace can slip in one or more pairs of eyelets that were tightened earlier, permitting the instep flaps to move apart and the boot to thus become relatively loosened. There are few simple structures known presently which permit one to pull the lace at a particular eyelet, and then to prevent the lace from slipping or retreating backwardly, other than for the user to maintain his or her grip on the lace.

In addition to the method described above, various other methods have been attempted for tightening laces. For example, some people use a mechanical "pick" or "puller" (commonly used by professional ice skaters) to gain a better mechanical advantage on a lace, and thus be able to pull it tighter or as tight as possible. Even with this system, however, when force pressure is released on the particular portion of the lace being pulled, the lace can slip or retreat back in an eyelet to a relatively looser portion. Another difficulty is the frictional resistance on the movement of the lace caused by the frictional engagement between the lace and the tongue, especially in the region where the lace becomes sandwiched between the eyelet-containing instep flaps of the shoe and the tongue.

Shoes have been employed for centuries by individuals seeking to protect the soles of their feet from the ground. The first shoes are believed to be sandals, which were constructed from a variety of natural elements such as bark, leaves, and vines. As time passed, factors such as climate conditions and fashion trends resulted in the evolution of the sandal into more sophisticated types of footwear, including tennis shoes and high heels. As shoes evolved, so did the ability to customize shoes for individual wearers. For example, shoes were made to custom fit the right and left feet of an individual. Further, shoes were modified to allow for different uses. High heels were created for elegant events and daily wear, while hiking boots provided traction footing for climbing over mountains and other physical impediments in nature.

Still further, shoes were manufactured such that they could be tightened to fit an individual's foot. Exemplary materials for tightening a shoe on a foot included, but were not limited to materials such as hook-and-loop fasteners, buckles, and hooks. However, by far, the most common material used to tighten a shoe is the shoelace. Shoelaces are generally defined as thin cords fitted to shoes to prevent a shoe from inadvertently slipping off a foot. While shoelaces are commonly used to tighten a shoe, it is an often time-consuming process. The current state of the art includes a shoe that is generally equipped with a plurality of eyelets running up the left and right side of the front of a shoe. The shoelace is positioned within the shoe in what is commonly referred to as a "figure eight" position, which provides for a vertical set of bands running across the front of the shoe between corresponding left and right eyelets. In order to tighten the shoe on a foot, an individual must first tighten the shoelace on the lowest band. The individual must then tighten the shoelace on the next highest band. The individual must continue this process throughout the entire vertical band to properly tighten the shoelace on the individual's foot so that the shoe is accordingly tightened.

Therefore, there is a need for a device that securely fastens a shoe, or other object, in a timely manner.

SUMMARY

The present invention is directed to a clasp for securing one or more objects by tightening. The clasp has at least two housings with an array of fingers extending into the center of the housings and a lock bar. Each array includes at least two fingers integrated into the housing. Each finger includes a base, a shoulder, and a wall. The base is the lower portion of the finger, and extending from the base is the shoulder and the wall. The shoulder is closest to the housing, while the wall is farthest from the housing; and separating the shoulder and the wall is a finger cavity.

Between the fingers is a recess. The purpose of the recess is to accept the finger wall of the fingers of the mating housing. The fingers form a transition fit within the recesses of the mating housing such that the mating housings form a seamless wall/shoulder complex that also aligns the finger cavities of the mating housings. The aggregated, aligned finger cavities form a longitudinal slot into which the lock bar forms a interference fit. The lock bar locks the fingers into the recesses such that prevents axial movement until the lock bar is removed from the slot. The clasp can be constructed such that there is substantially no open space within the clasp upon joinder such that no slack leads to prolonged wear of the clasp.

Other embodiments of the present invention include fingers that fit not only within recesses, but also within fingers of the mating housing. In such embodiments the open fingers may include shoulder voids and wall voids such that closed fingers (that lack wall voids and shoulder voids) may fit within the fingers. Wall portions surrounding the wall void may be fitted into the recesses.

These aspects of the invention are not meant to be exclusive. Furthermore, some features may apply to certain versions of the invention, but not others. Other features, aspects, and advantages of the present invention will be readily apparent to those of ordinary skill in the art when read in conjunction with the following description, and accompanying drawings.

DETAILED DESCRIPTION

Figure 1:
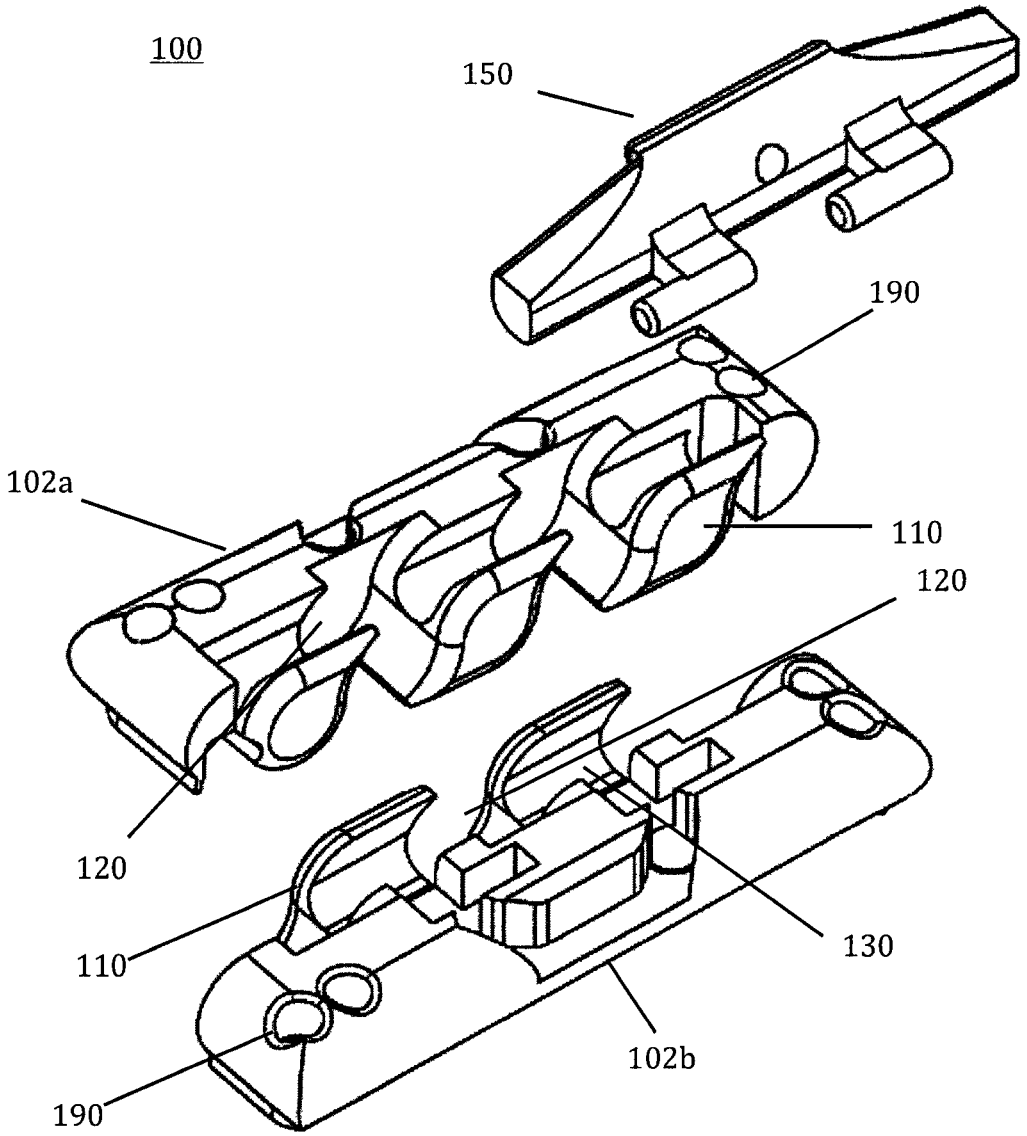
FIG. 1 is a perspective view of the unassembled clasp of the present invention.
Figure 2:
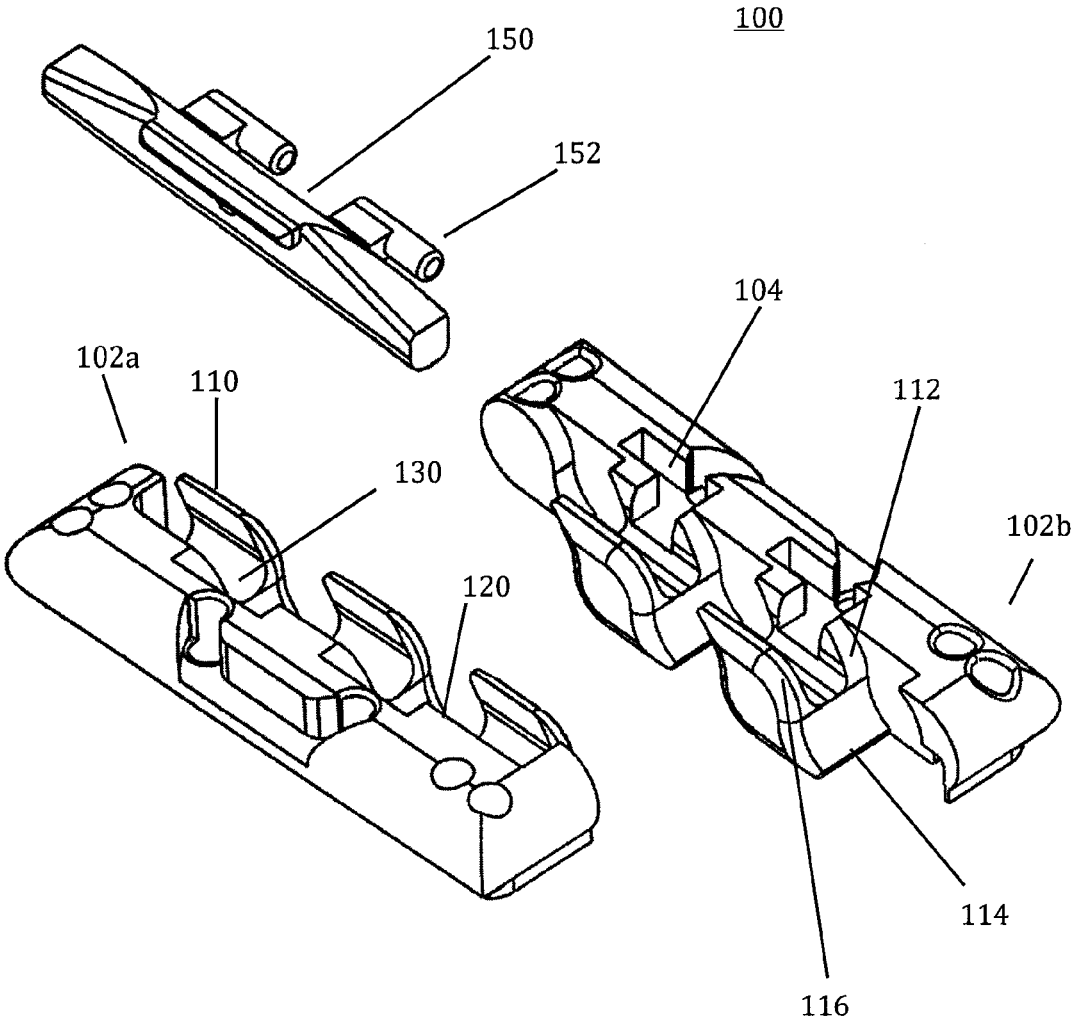
FIG. 2 is a perspective view of the unassembled clasp of the present invention.

Referring first to FIGS. 1-2, a basic embodiment of the clasp 100 of the present invention is shown. The clasp 100 includes at least two housings 102, shown here as a first housing 102*a* and a second housing 102*b*. The preferred housings 102 include perforations 190 to permit one or more fasteners (not shown) to join to the housings 102. The housings include fingers 110 integrally extending from the housings that fits within recesses 120 between the fingers 110. The fingers 110 include cavities 130, that upon joinder of the first housing 102*a* to the second housing 102*b*, the cavities align to form a slot (not shown). Upon joinder, a lock bar 150 fits within the slot to lock the housings together until the lock bar 150 is removed or rotated.

Each housing 102 includes an array of fingers 110 that has a finger base 114, a finger shoulder 112, and a finger wall 116. The base 114 forms a support for the finger wall 116 and finger shoulder 112, and between the wall 116 and shoulder is the finger cavity 130. As shown by reference to FIGS. 3-7 in conjunction with FIGS. 1-2, the housings 102 fit together to lock one portion of a fastener 900 to another. The clasp 100 is meant to be used in conjunction with a fastener 900 on an adjustably sized object 902. By adjustably sized object, it is meant an object that changes its size based on the actuation of one or more fasteners 900. The adjustment in size can be for the basis of either locking the object or adjusting the fit of the object about another object. A fastener for purposes of the present invention includes an entity affixed, temporarily or permanently, to an object for the purposes of adjusting the size of the object, or locking the object. The object 902 presently depicted is a shoe, or more accurately here the shoe flaps and tongue, and the fastener 900 presently depicted is a shoelace. The shoelace is wound through the eyelets of the shoe and into perforations 190 on the housings 102 of the clasp 100 sized to receive them.

It is preferred that the present invention include housings manufactured for predetermined fasteners. The predetermined fasteners may be generally considered, for example "shoe laces" or the fasteners may be sold with specific fasteners in a kit. The preferred fasteners used with the present invention are flexible and elastic so as to permit the fasteners to pass and wind through multiple perforations 190 within each housing. Having perforations in multiple positions within the housing, including at flanking positions, permits the clasp to maintain an joinder orientation without swiveling. By flexible it is meant that the fastener bends, by elastic it is meant that the fastener axially compresses in order to permit an interference fit within the housing perforations.

Figure 3:
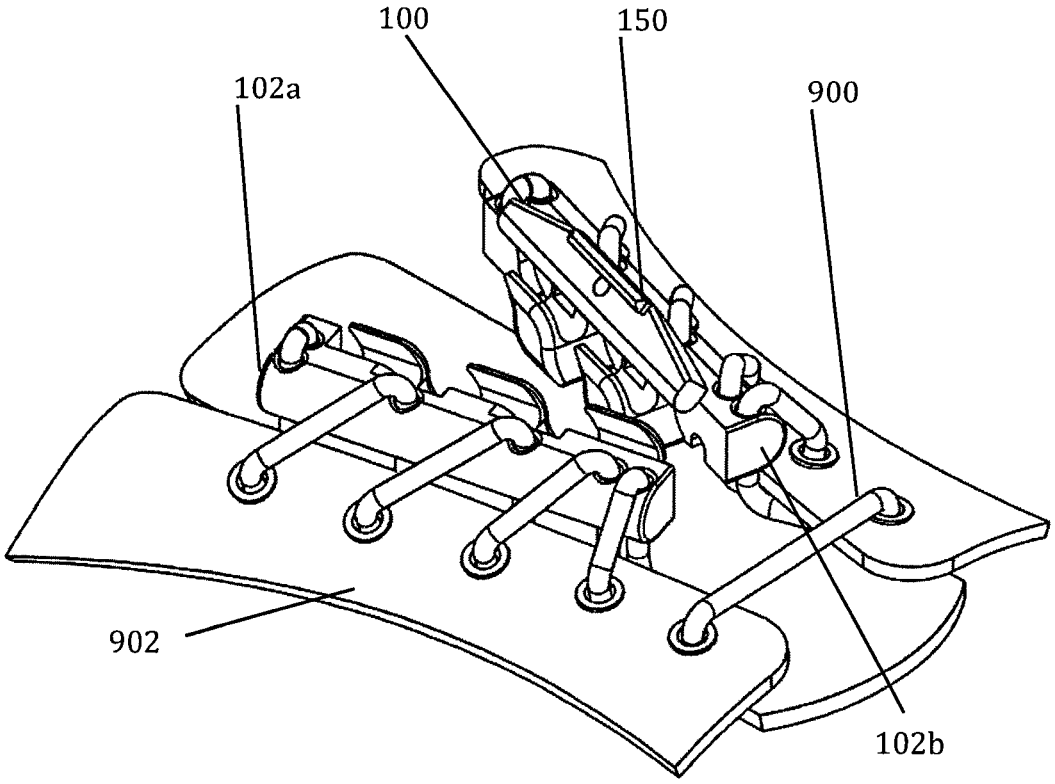
FIG. 3 is a perspective view of the unassembled clasp of the present invention affixed to a fastener on a lockable object.
Figure 4:
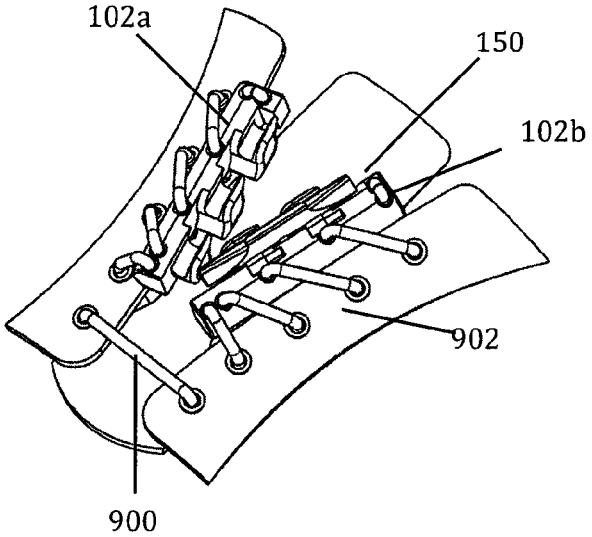
FIG. 4 is a view of the clasp affixed to a fastener on a lockable object.
Figure 5:
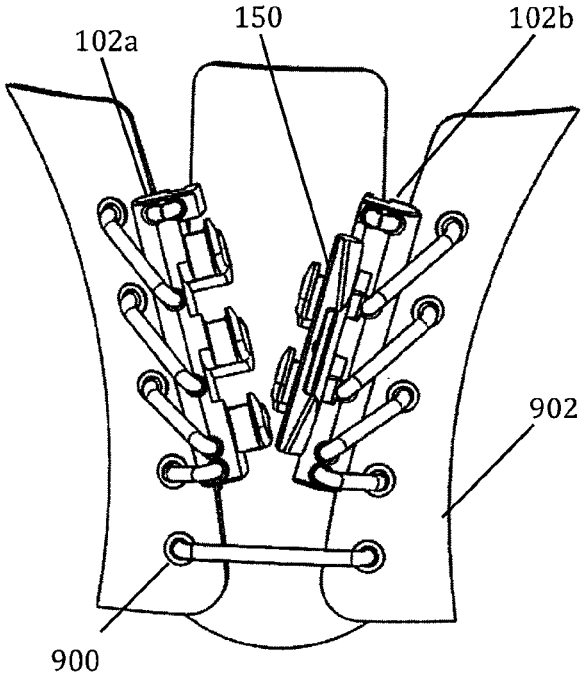
FIG. 5 is a view of the clasp affixed to a fastener on a lockable object.

The housings 102 may be attached to the fastener 900 by winding the fastener through the perforations 190. In a release position as shown in FIG. 3, the housings are separated and the fingers 110 need not be in contact one with the other. The object 902 may be sized at a release position, which permits less slack in the object than a joinder position. The object size at the release position may be greater than the size at the joinder position. Here, the release position permits the shoe flaps to be released to permit a foot to slide into or from the shoe.

Figure 6:
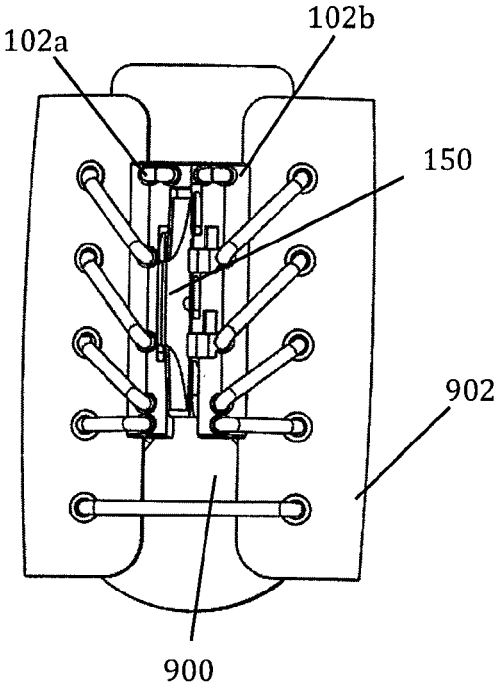
FIG. 6 is a view of the clasp affixed to a fastener on a lockable object closed.
Figure 7:
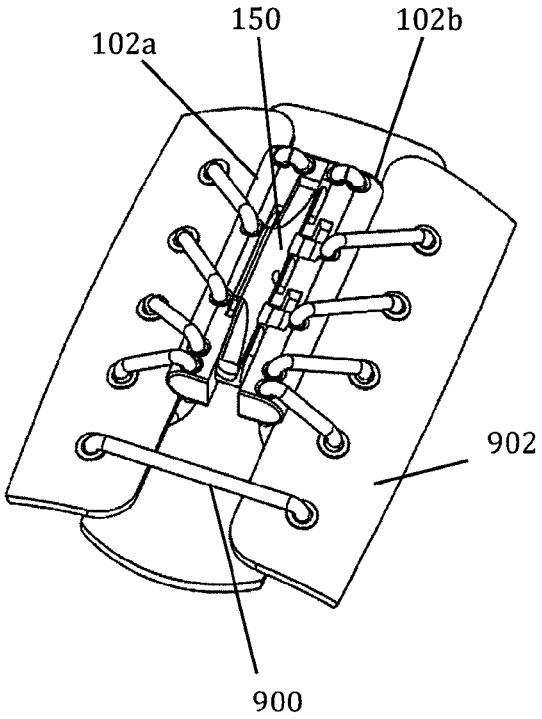
FIG. 7 is a view of the clasp affixed to a fastener on a lockable object closed.
Figure 8:
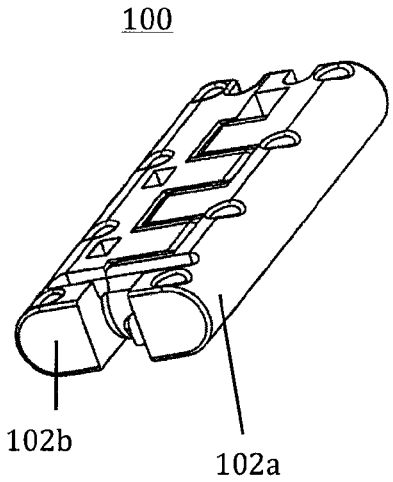
FIG. 8 is a perspective view of the clasp of the present invention bottom view.
Figure 9:
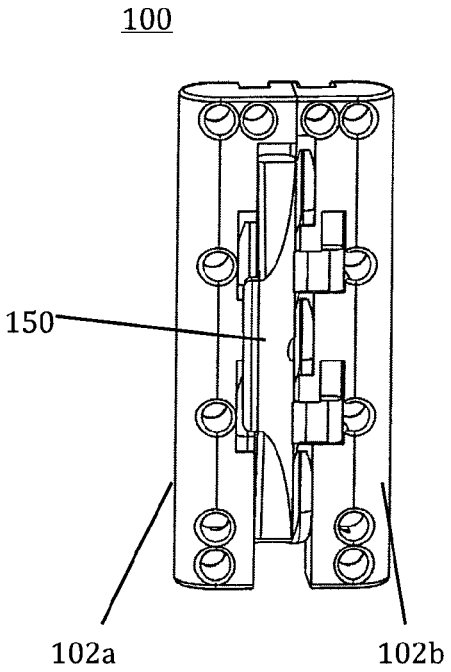
FIG. 9 is a perspective view of the clasp of the present invention top view.
Figure 10:
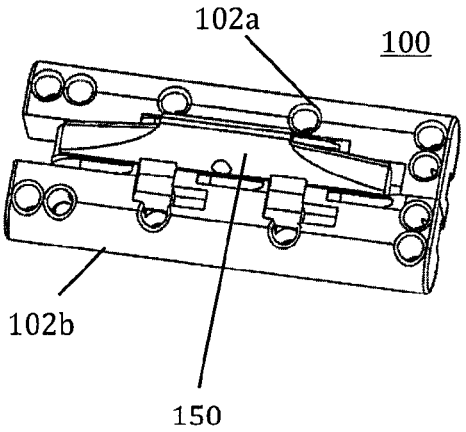
FIG. 10 is a perspective view of the clasp of the present invention.
Figure 11:
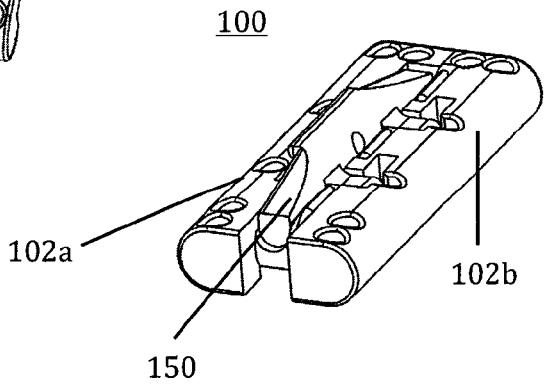
FIG. 11 is a perspective view of the clasp of the present invention.

The housing portions 102*a*, 102*b* may then be pushed together to join the housings into the joinder position as shown by FIGS. 6-7. The array of fingers 110 of the first housing 102*a* are then pushed into the recesses 120 of the second housing 102*b*, while simultaneously pushing the array of fingers 110 of the second housing 102*a* into the recesses 120 of the first housing 102*a*. By interlocking the fingers, a pattern is formed for each housing such that the shoulder is abutting the wall in a repetitive shoulder/wall/shoulder/wall/ . . . pattern. It is preferred that the shoulder/wall complex forms a flush interior continuous slot sidewall. The slot is formed by the aggregation of the finger cavities into an alignment that creates a seamless trench. By seamless, it is meant that the cavities unite in a manner that creates a single aperture capable of functional use in the aggregate, rather than only cavity-by-cavity. It is preferred that the floor of the slot, which may be the aggregated bases 110 of the fingers, present a flush bottom surface of the slot.

The lock bar 150 is then pressed into the slot of the clasp 100 to maintain the clasp in the joined position. The lock bar 150 is preferably dimensioned such that it forms an interference fit with respect to the slot. By interference fit, it is meant that the dimensions of one entity are sized to present resistance to either the entry or exit of that entity into another entity. Here the lock bar is preferably sized slightly larger than the slot to require substantial force to press the lock bar into the slot, say for example, a force capable of application by a small child. The frictional force prevents the lock bar from inadvertently releasing from the joinder position. The nature of the present invention ensures that a minimal of resistance is required, the use of multiple interlocking components meticulously sized to present a transition fit with respect to one another ensures that only force applied is a specific direction (almost exactly axial) is required to release the housings even from their transition fit. The interference fit may arise due strictly to one component having greater dimensions than another, or the interference fit may arise because at a particular orientation one entity has greater dimensions than another. For example, in the embodiment of FIGS. 1-7, the lock bar bears dimensions slightly less than the slot of the joined cavities, however, because the lock bar 150 is joined to one of the housings 102 by grasps 152, shown here as hinge barrels, to grasp ports 104, here as cylindrical apertures. The grasps 152 of the present invention include any means of affixing a lock bar to one or more of the housings of the present invention, directly or indirectly, and the grasp ports include the component to which the grasps are affixed.

Figure 12:
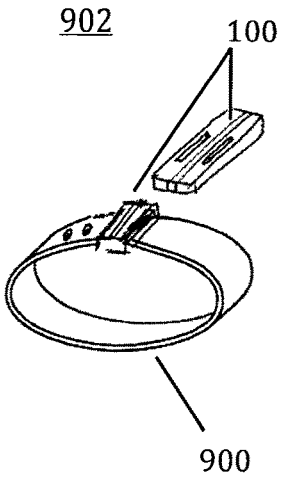
FIG. 12 is a view of the clasp positioned on an object.
Figure 13:
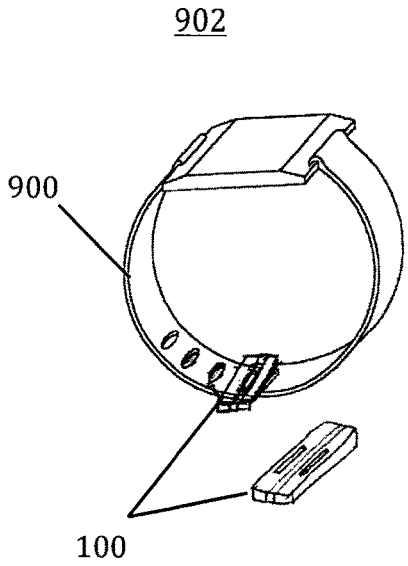
FIG. 13 is a view of the clasp positioned on an object.
Figure 14:
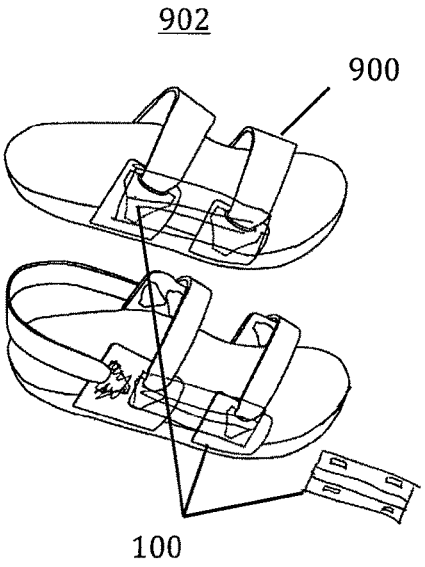
FIG. 14 is a view of the clasp positioned on an object.
Figure 15:
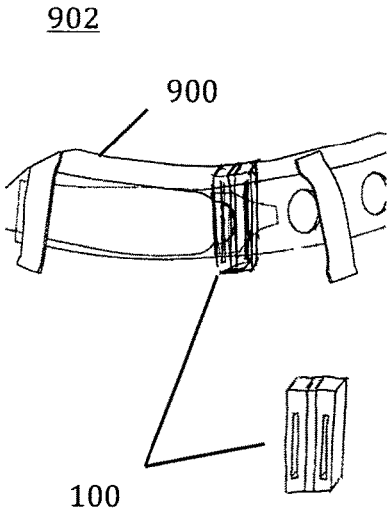
FIG. 15 is a view of the clasp positioned on an object.
Figure 16:
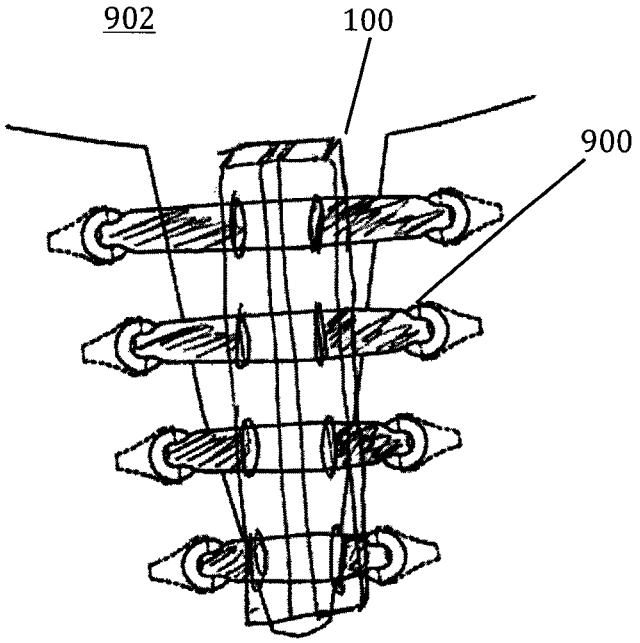
FIG. 16 is a view of the clasp positioned on an object.
Figure 17:
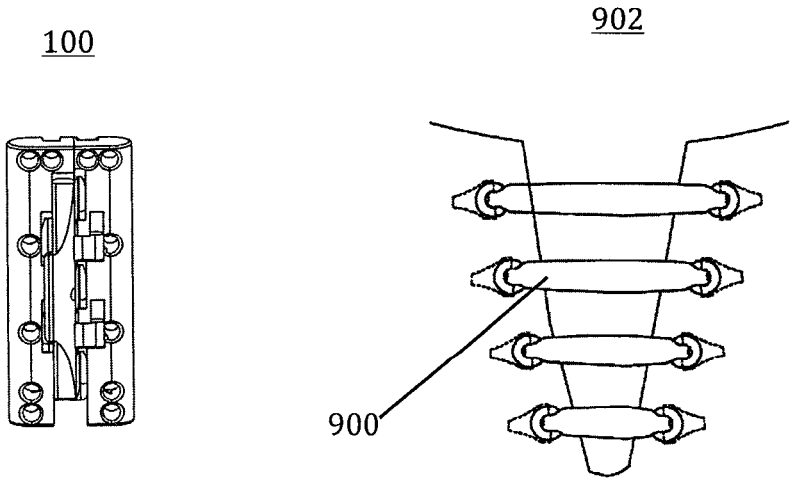
FIG. 17 is a view of the clasp and an object.

When joined as shown in FIGS. 8-11, the clasp 100 will hold the object 902 in a locked position until a user desires to release the object 902 and the fastener(s) 900 holding the object in the locked position. The present object is not meant to be restricted to any particular object. As shown by FIG. 12, the present invention may be used as a clasp 100 with a hospital band 902 with a band fastener 900 (in such a scenario, the housing perforations would be rectangular and single rather than circular and multiple). As shown by FIG. 13, the present invention may be used as a clasp 100 with a watch 902 with a band fastener 900 (in such a scenario, the housing perforations would be rectangular and single rather than circular and multiple). As shown by FIGS. 14-15, the present invention may be used as a clasp 100 with sandals 902 with a band fastener 900 (in such a scenario, the housing perforations would be rectangular and single or double [depending on the number of straps and whether the user desires one or multiple clasps] rather than circular and multiple). A preferred commercial use of the clasp 100, as shown by FIGS. 16-17 is in connection with garments 902 and laces 900. The laces 900 are wound into the perforations of the clasp 100 to permit one housing 102 to be on each side of the garment edge 902. Here there are multiple perforations sized to accept the lace dimensions and materials.

Figure 18:
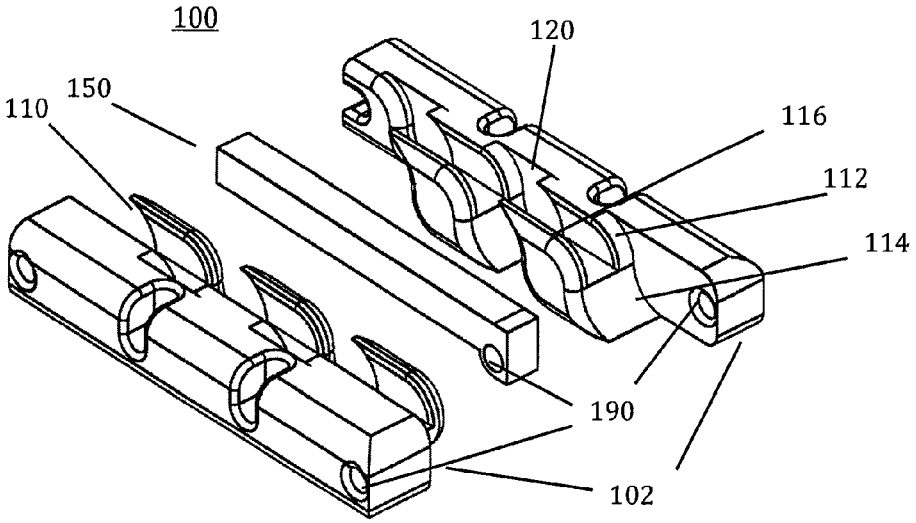
FIG. 18 is a perspective view of the unassembled clasp of the present invention.
Figure 19:
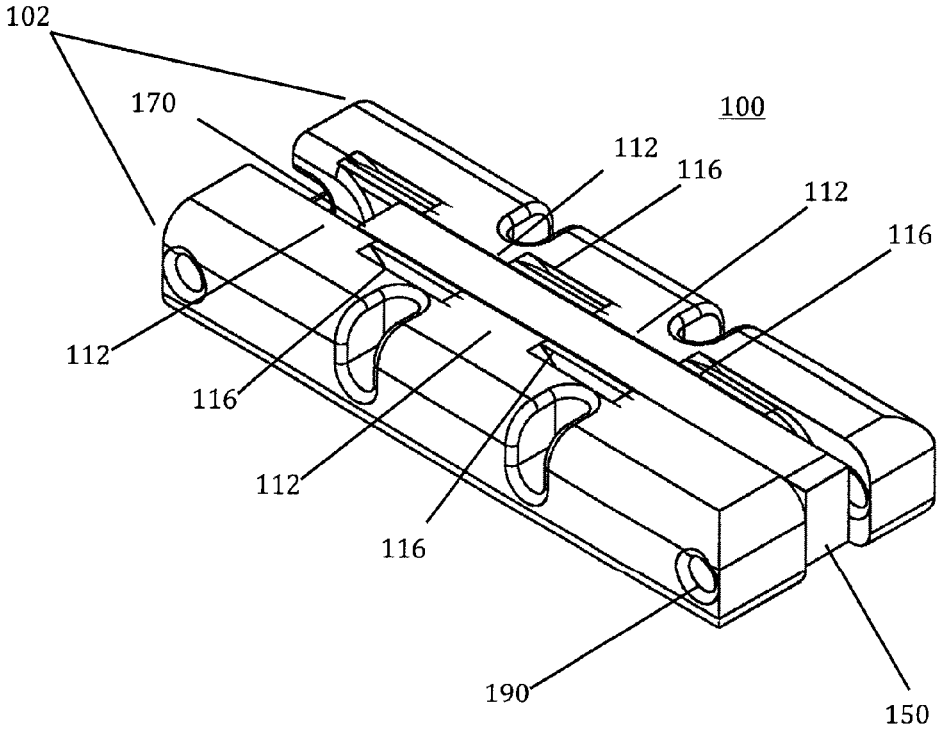
FIG. 19 is a perspective view of the clasp of the present invention.

Turning now to FIGS. 18-19, a different embodiment of the clasp 100 is shown. In the depicted embodiment, the lock bar 150 is not affixed directly to either of the housings 102. Instead, the lock bar 150 includes perforations 190 that accept a fastener (not shown), ideally the same fastener that is wound into the perforations 190 of the housings 102. A shoe lace may be wound through one of the housings 102, then through the lock bar 150, and then through the other housing 102. As the housings are brought into contact, similarly the lock bar will be drawn closer to each of the housings, and if the perforations are machined in the proper orientation, the lock bar will be properly aligned with the housings such that it can be pushed into the slot 170 upon joinder. The dimensions of the slot 170 are created by the aggregation of the arrays of fingers 110 on each of the housings, and more specifically, the floor of the finger cavities (frequently the base 114) in combination with the complex of finger wall 116 and finger shoulder 112 fits along the center of the joined housings 102. The lock bar 150 fits within this slot 170 to prevent at least axial movement of the housings, however, as shown in FIG. 19, the lock bar need not extend to the longitudinal extremities of the clasp.

Figure 20:
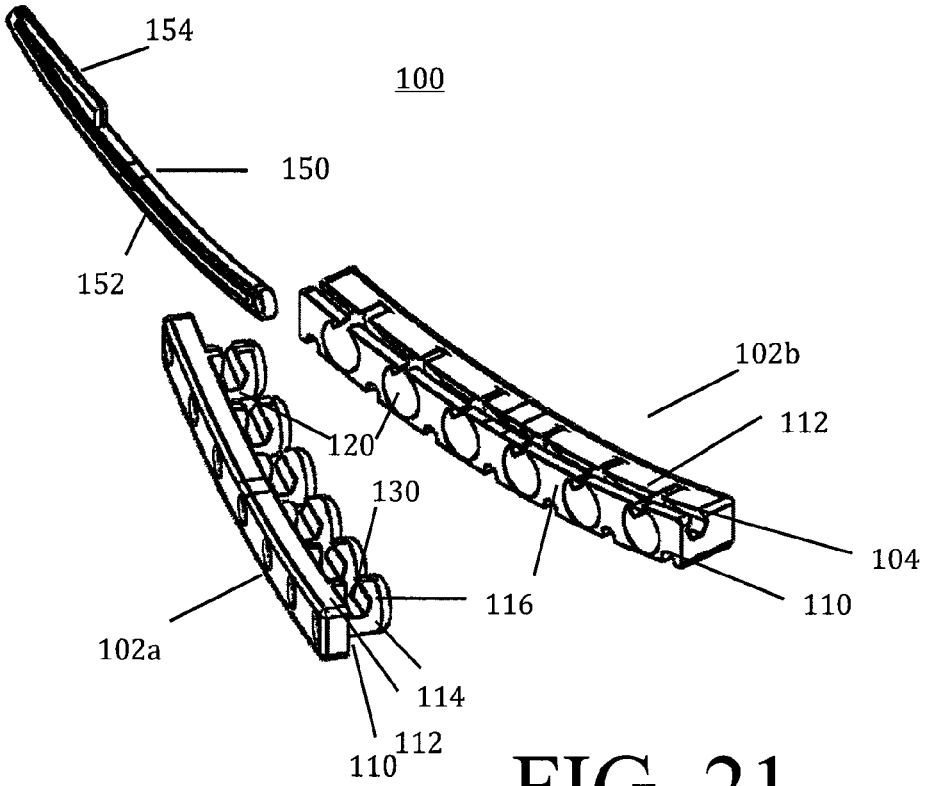
FIG. 20 is a perspective view of the clasp of the present invention.
Figure 21:
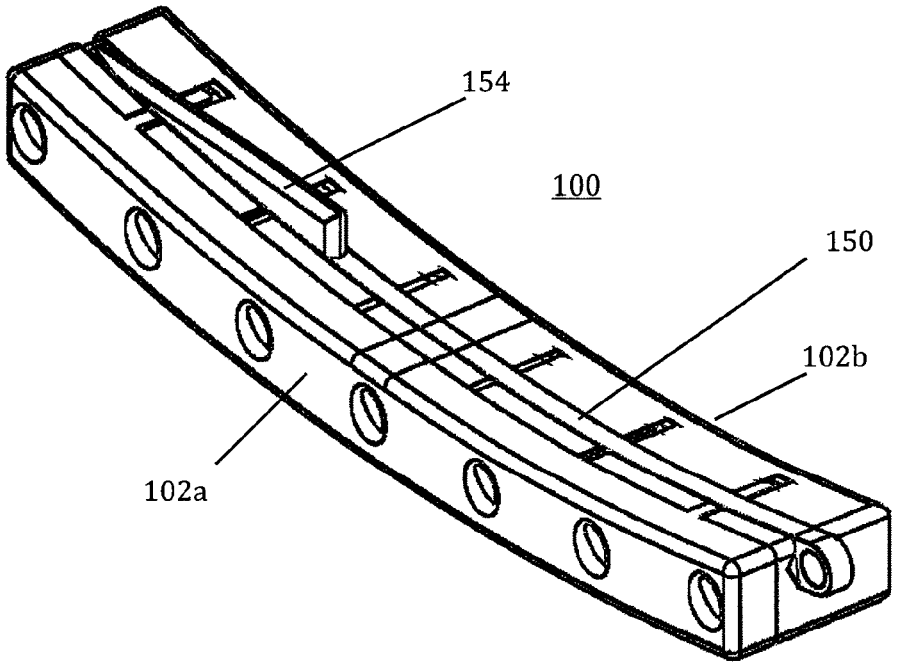
FIG. 21 is a perspective view of the clasp of the present invention.

As shown by FIGS. 20-21, there is no need that the components of the clasp 100 include any sort of symmetry. In other words, the fingers 110 of one housing 102 need not resemble the fingers 110 of the other housing 102, as well as the recesses 120 or housing 102. The first housing 102*a* depicts a housing version utilizing bulb fingers. The fingers fulfill the general aspects of the fingers of the present invention, they include a base 114, a shoulder 112, and a wall 116. The finger wall 116 includes a bulbous projection at the extremity that mates with a matching recess 120 in the mating second housing 102*b*. The fingers 110 of the second housing 102*b* include finger walls 116 dimensioned to fit around the bulbous fingers 100 of the first housing 102*a*. The finger cavities 130 of the different housings 102 nonetheless line up upon joinder and the lock bar 150 slides into the slot formed by the aggregated finger cavities. The grasp 152 and grasp port 104 of the depicted version form a tongue-and-groove assembly, respectively. A tongue 152 is positioned on the sides of the lock bar that forms a transition fit with the grooves 104 of the housings 102. The lock bar 150 may be slid readily into and from the slot with simple hand pressure, including with the assistance of a lock bar protrusion 154 that permits finger pressure against the lock bar while in its lock position. In the depicted embodiment, it is preferred that the lock bar and housings include curved dimensions that prevent the lock bar from inadvertently dislocating from the joined housings. The lock bar 150 may longitudinally extend from the housings 102.

Figure 22:
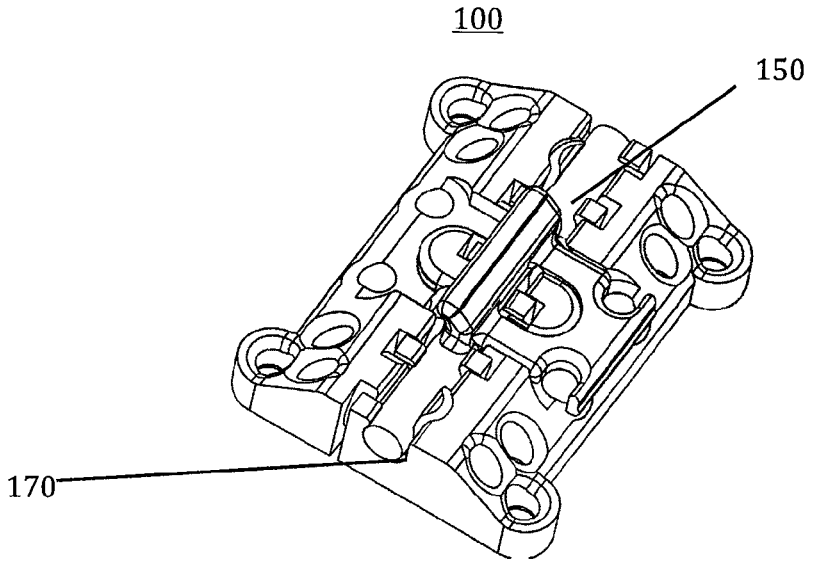
FIG. 22 is a perspective view of the clasp of the present invention.
Figure 23:
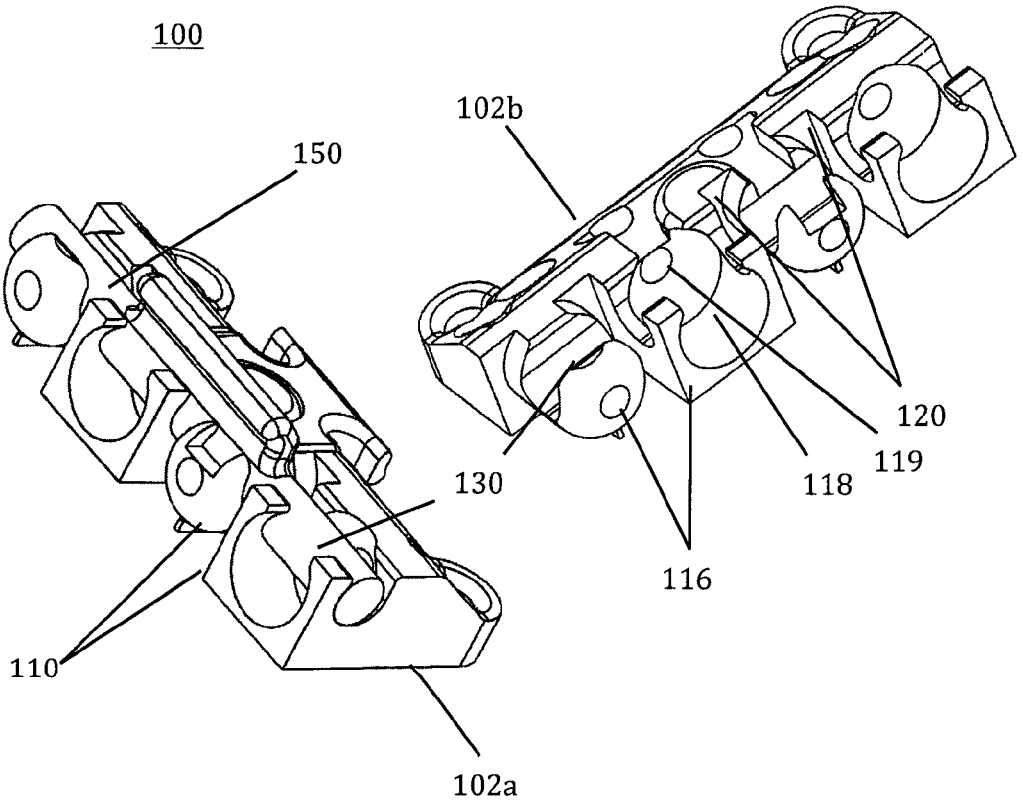
FIG. 23 is a perspective view of the clasp of the present invention.

Turning now to FIGS. 22-23, a preferred embodiment of the clasp 100 is depicted. The clasp includes two housings 102*a*, 102*b* that include an array of fingers 110. The fingers include alternating finger types, here bulbous fingers and negative bulbous fingers. Here, the housings 102 include recesses 120 that differ in dimensions to accommodate the differing finger types. The finger types herein may be described as open fingers and closed fingers. The open fingers include the base 114, wall 116, and shoulder 112 of the finger of the present invention, however, they further include a wall void 118 and a shoulder void 119. The other fingers, closed fingers, are inserted into the open fingers such that the interlocking nature of the present invention is multiplied by fingers 110 interlocking into fingers 110 as well as fingers interlocking 110 into recesses 120. Specifically, the closed fingers are inserted into the open fingers, while the portions of the open finger wall 116 abutting the wall void 118 insert into the recesses 120. The wall 116 of the closed finger fits within the wall void 118 through the finger cavity 130 and then into the shoulder void 119.

Returning to FIGS. 1-2, the preferred fingers 110 and recesses 120 of the present invention are contoured to promote a simple transition fit when the housings 102 are pressed together when parallel, and almost parallel, but complicates integration and release from other angles. Each longitudinal and axial skewing of the components promotes a stronger fit that fails to interfere with achieving the transition fit. The fingers of the embodiment of FIG. 1, for example, include finger walls 116 that are axially curved. Recesses are dimensioned to accommodate axial finger curving. Furthermore, the fingers include longitudinal skewing both along the base 114 and for the finger walls 116. It is further preferred that the finger walls 116 include opposite longitudinal skewing such that the finger wall is distorted in one longitudinal direction above the height of the base 114, while the wall is distorted in the opposite longitudinal direction below the height of the base 114. The recesses 120 (and to the extent other voids exist) are dimensioned to accept the finger dimensions as a transitional fit that is as close to seamless as manufacturing such as machining or molding will permit.

Figure 24:
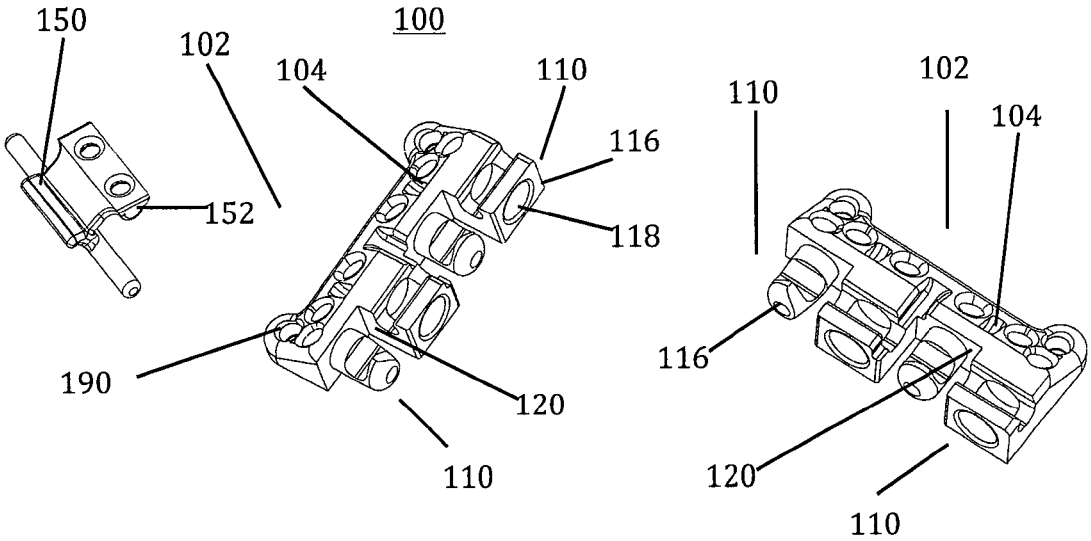
FIG. 24 is a perspective view of the clasp of the present invention.
Figure 25:
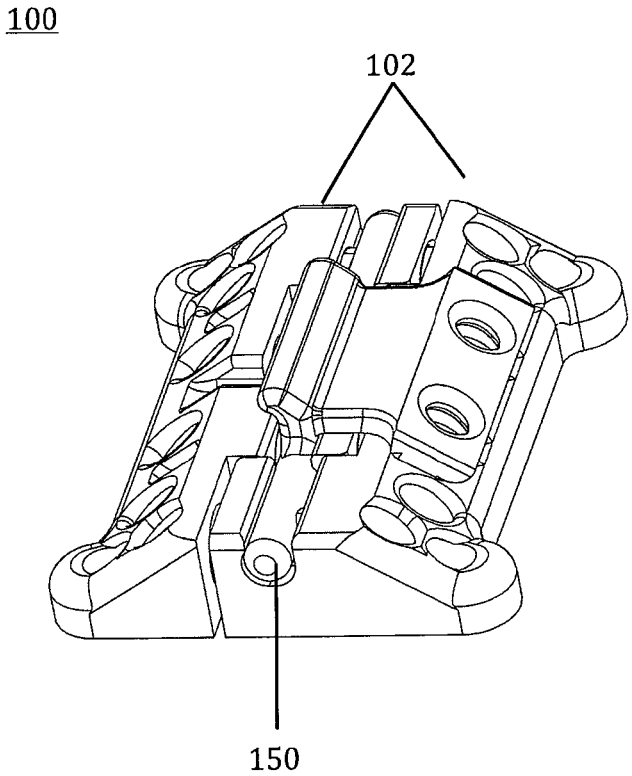
FIG. 25 is a perspective view of the clasp of the present invention.
Figure 26:
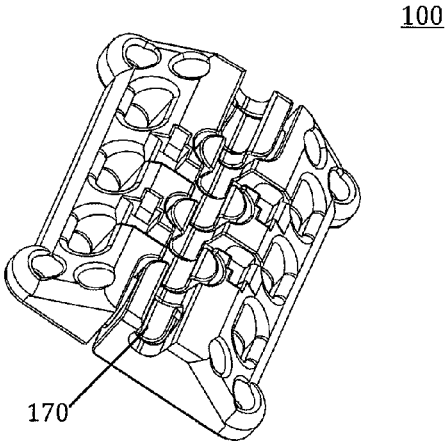
FIG. 26 is a perspective view of the clasp of the present invention (lock bar removed).
Figure 27:
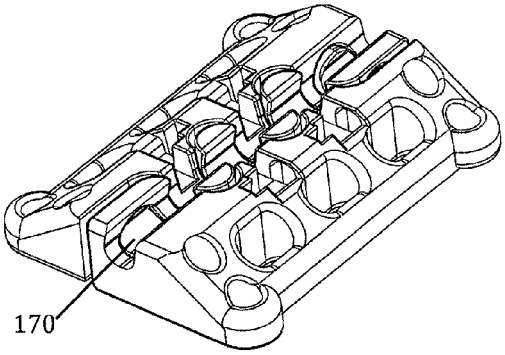
FIG. 27 is a perspective view of the clasp of the present invention (lock bar removed).
Figure 28:
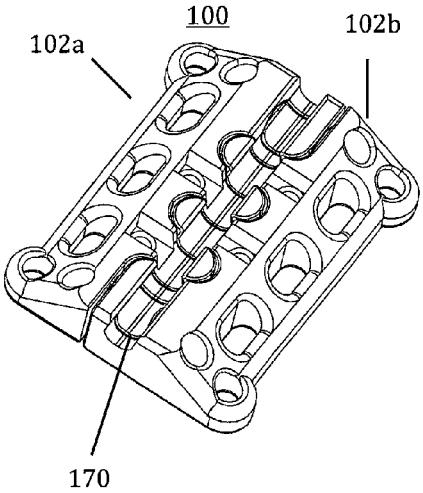
FIG. 28 is a perspective view of the clasp of the present invention (lock bar removed).
Figure 29:
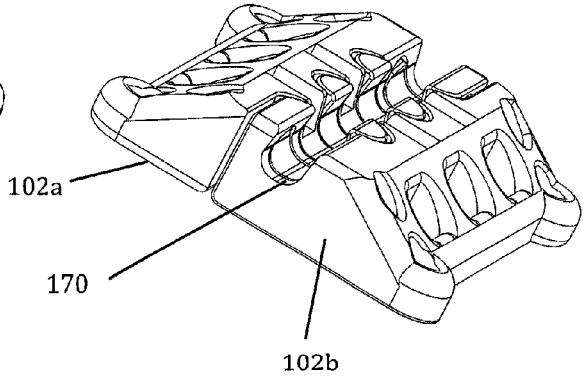
FIG. 29 is a perspective view of the clasp of the present invention (lock bar removed).

Turning now to FIGS. 24-25, a preferred version of the present invention is depicted. The clasp 100 includes housings 102 that are both identical and complementary. The identical housings 102 may be formed from the same mold, however, with appropriate dimensioning, the fingers 110 and recesses 120 and finger walls 116 and wall voids 118 may nonetheless interlock. A further advantage of identical, interlocking housings is that the destruction or misplacement of one of the housings 102 permits simple replacement by purchase of a single housing 102 applicable to replace either housing. The identical, complementary housings 102 may both include grasp ports 104, either capable of accepting grasps 152 having keyed flag spots with round pivots for rotatable actuation. Further acceptable lock bar 150 designs feature grasps 152 with two close pin like legs that just press into simple holes 104 and lock in place with a living hinge as a pivot mechanism.

FIGS. 26-29 illustrate the joinder of the clasp 100 without a lock bar (not shown) to show the nature of the slot 170. When the fingers and recesses are interlocked, the finger cavities align to form the slot 170. The preferred slot is comprised of finger cavities with smooth sidewalls, but in any case, the slot is dimensioned to accept the dimensions of the lock bar in an interference fit. There should be no space between the neighboring fingers of the clasps when joined, which for purposes of the present invention means that the space between fingers should be the minimum capable of being achieved with applicable fabrication techniques. The slot sidewalls and base wall should be substantially seamless in this regard.

The less space between neighboring fingers, the greater support that the fingers may provide to neighboring fingers. This is a benefit of the transition fit of the present invention. In the face of longitudinal force, the interlocked fingers form a united, solid article that provides multiplied buttressing and leaves no finger to absorb force to a degree greater than other fingers. In the face of latitudinal force, the transition fit (which is preferred) between the finger walls and the recesses permits the separate housings to respond to the applied force substantially as a single article. The clasp is nonetheless capable of achieving the objectives of the present invention with significant gaps between fitting components; however, such construction is less preferred. The space between interlocking components, fingers/fingers and fingers/recesses and lock bar to slot is referred to herein as "interlock space." The closer the aggregated interlock space is to zero, the sturdier the clasp. Zero interlock space means such space as formed by a transition fit wherein two components are in contact, but not in a manner that applies force from one component to another based on the component dimensions. It is preferred that the clasp have a volumetric transition fit, which results in zero interlock space.

Returning to FIGS. 3-7 and 16-17 other forms of the present invention feature a fastening system comprising the clasp 100 along with a garment 902 with a fastener cluster composed of multiple fasteners 900. Fasteners frequently interfere with garment aesthetics, whether the aesthetics include design or brand placement, and the fastener style is a design afterthought selected for utility rather than aesthetics—and may even detract from the aesthetics. A traditional way to size is constructing a garment 902 with garment edges 920 and these edges are adjustable to conform to the dimensions of a user. The edges 920 are brought closer to tighten, and spread apart to loosen or remove the garment. It is often the case that such a mechanism leaves a considerable amount of unusable space between the garment portions occupied by the fastener cluster. In the case of shoes and dresses, for example, the open space between the garment edges may significantly overshadow the space occupied by the fasteners by orders of magnitude. The present invention remedy the problems posed by the fastener cluster by both covering the cluster and supplying an additional space for advertising or design.

Figure 30:
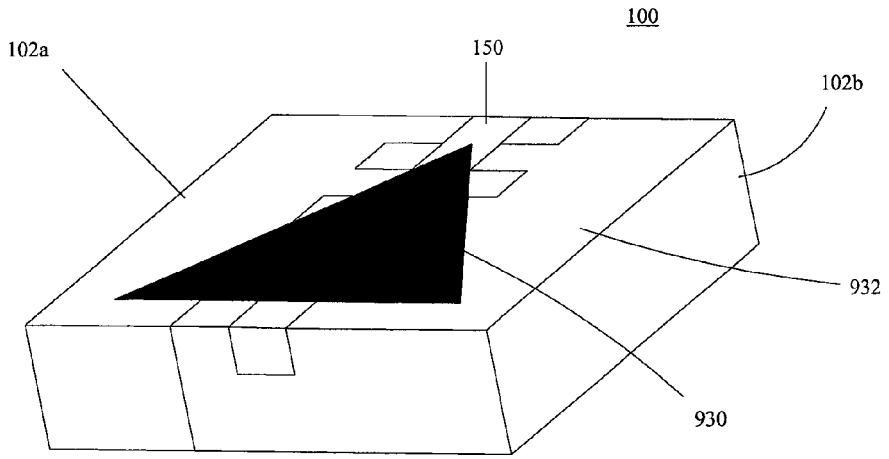
FIG. 30 is a perspective view of the clasp of the present invention.
Figure 31:
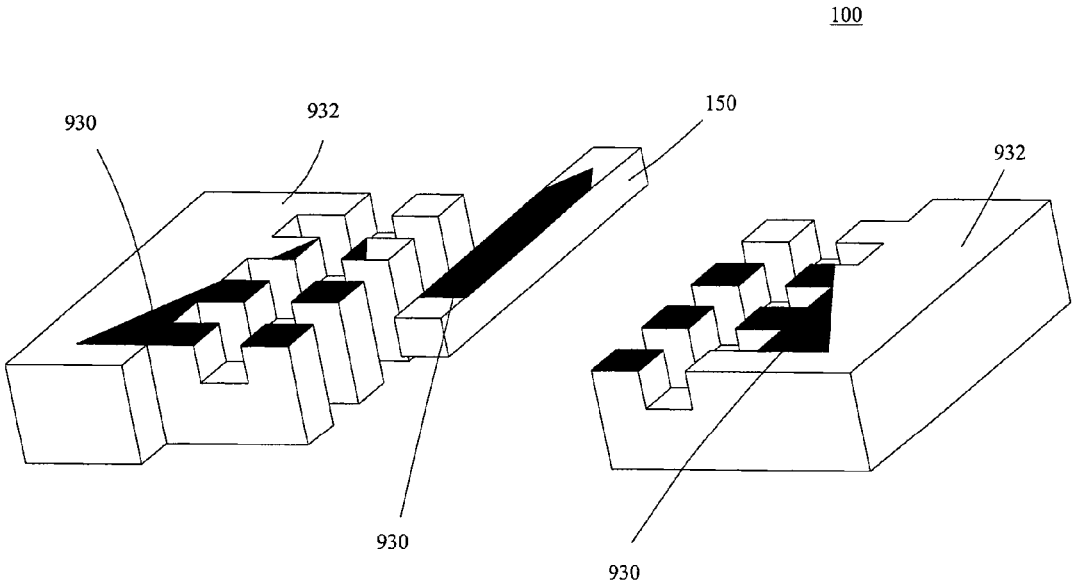
FIG. 31 is a perspective view of the clasp of the present invention.

When a clasp occupies a loose fastener cluster, additional design or advertising may be supplied to a garment. For purposes of the present disclosure, a loose fastener cluster includes a fastener cluster that includes open space, as a function of surface area when looking directly upon the fastener (for example, as in FIGS. 16 and 17), equal to or greater than the surface area occupied by the fastener. The open space is a measurement of the space between the garment edges, and does not include ancillary garment components such as shoe tongues and dress inner linings. Turning now to FIGS. 30-31, the ideal clasp for use with loose fastener clusters includes a clasp with a substantially flat upper surface 932, inclusive or exclusive of the lock bar 150. The flat upper surface displays the advertising or design (collectively "illustration"). The illustration 930 may be applied in any manner known in the art. The illustration 930 may be divided among the components of the clasp 100. The illustration may be applied to both housings 102, or may be applied to both housings 102 and the lock bar 150. Upon joinder, the housings will by nature of the press fit line up the portions of the illustrations seamlessly. Furthermore, the application of the illustration on the lock bar 150 further permits the lock bar, to the extent that it may not be automatically aligning by nature of its joinder to a housing, to be positioned in a predetermined position by viewing the alignment of the illustration portion on the lock bar to the illustration portion on the housings. A zero tolerance fit permits seamless viewing of the illustration on the clasp. Furthermore, the upper surface of the clasp may match design features of the garment, including the color, pattern, etc. The component-component fits need not be zero tolerance; neither does the upper surface require flat dimensions.

Various embodiments of the clasp may include a transition fit locking clasp fastener composed of one or more rubbery and not stiff rigid injection molded material substances that could be configured such that the housings may be stretched. For example, in various embodiments the housings could be configured to be stretched by at least 5, 10, 15, 20, 30 or 50 percent, for tightness adjustment, but shoe lace ties are the most user friendly and easily adjustable common method for the user to customize the shoe fit and tightness to his/her individual preference. As is described further herein, the clasps may be used in a variety of applications includes fastening footwear. The elasticity of the clasp may be varied by changing the elastomeric substance or other substances used in the clasp. Additionally, the desired tension across the face of a shoe, or other article, may be controlled by changing the length of the body of the clasp. Variation of the elasticity and length may render different elastomeric clasps suitable for use in different circumstances.

In various embodiments, the body of the clasp includes a rectangular shape of between 25 mm (approximately 1 inch) to 75 mm (approximately 3 inches) long for common shoe wear with no limits scaled up or down in size and approximately 6 mm (approximately 0.25 inches) to 25 mm (approximately 1 inch) wide. For tall boots and tall lace up shoes multiple inventions of this design could be placed in series as required for the number of eyelets of for the height of the footwear. This also allows some footwear flexing at the midpoint of the lacing uppers for ankle rotation and flexibility. At each end, the rectangular shape narrows toward the curved, down-turning portions at both sides and finally terminates at a rounded smooth edge where lace holes can be molded. A desired tension is achieved by pulling taught an appropriate length of the shoe lace tie relative to coupling points of an article, a variation in material durometer of shoelace, or by varying the force pulling on the laces. For example, if the coupling points include the eyelets of a shoe, a desired tension across the face of the shoe is achieved by choosing a tension that results in an appropriate pull of mounting plate fastener when the clasp is attached between the eyelets. This tension may affect performance as well as the ease by which the shoe is taken on and off. The body of the clasp may take on a variety of widths, lengths, colors, materials, and configurations depending upon aesthetic and functional requirements. These variations are illustrated further in the figures. In some embodiments, the housing of the clasp is the point at which the clasp's properties are most critical.

The tightness of the fastener can be affected by many factors and the desired tension across the face of the shoe is affected by the force of the shoe string and taughtness linking the shoe upper to the body of the fastener and this is controllable with this design. For example, athletes may prefer a shoe that is fixed very tight to the foot and feels as though it is part of the body. Alternatively, someone that wears a shoe for comfort, short periods of time or in a location that dictates different shoes over the course of a day may desire a shoe that is loose fitting and easily taken on and off. Some embodiments included a fastener that may be manufactured in different configurations of material and fastener body length to achieve different functions. ie tall boots may need to have a series of smaller press fit locking clasp fasteners in series to give angle flexibility but also secure attachment to the users foot.

In some embodiments, the clasp is configured for use such that the shoe lace ends pass into an eyelet and are then hidden under the surface of a shoe. In other embodiments, the shoe lace end configuration that allows locking and passing through the double eyelet and is configured to come up through the eyelet and be locked above the surface of the shoe. In these embodiments, part of the rectangular region may be disposed below the surface of the shoe as the rectangular region passes across the shoe tongue.

The clasp may be made of any plastic, wood or metal materials that provide a desired performance and fit. A variety of different types of silicone, rubber, castable polyurethane (CPU), Thermoplastic Elastomer (TPU, TPE), or any other elastic material, may be chosen based on their properties, the variety of which are consistent and known to those manufacturers that supply such. The clasp may also be composed of more than one type of each particular material, depending upon the desired shape, color and configuration. The clasp may also be composed of some of the materials mentioned herein as well as non-elastic material or materials that have different elastic qualities but serve a purpose such as adding durability to housings and lock bars. The clasp may also be composed of some of the above-mentioned materials in addition to substantially different materials that have elastic qualities such as a plastic or metal spring. A spring may be added in place of such shoe string tie materials to add resiliency and tension as well as desired aesthetic qualities.

The clasp may be composed in part of materials that are not elastic in order to allow the fastener to be more rigid, more durable, or more easily grabbed in particular locations. The clasp end may be altered such that the terminus of the shoe string tie linking end or the locking bar member may be composed of plastic, metal, adhesives, or any other variety of materials that facilitate gripping. The end may also be configured such that the terminus is a variety of shapes, such as a sphere or elliptical object that appears to be integrated into the clasp. The object may be narrow enough to pass through between shoe uppers and the shoe tongue but wide enough to be grabbed and pulled by the user to engage and disengage the lock bar and to grip the housing portions to draw them together and engage the lock bar for one handed complete interference fit.

The transitions of form and shape that occur along the clasp's length are particularly resistant to damage and tear because of the forces that are intrinsic to this type of object. Therefore, many materials other than injection molded plastics may be used in areas such as the possible advertising outside edges of the housings, or in the lock bar. In some embodiments, the clasp is to be altered such that it is molded to accommodate other materials that simply slide in place on the housings and are fixed. Other embodiments include co-molding an alternate material with the elastic material of the clasp to form a unified object. The clasp may be made in a pouring process whereby hot rubber, silicone, castable polyurethane (CPU), Thermoplastic Elastomer (TPU, TPE) or alternate elastic materials are poured in a custom mold. The clasp may also be injection molded whereby substances such as Thermoplastic Elastomer (TPU, TPE) or alternate elastic materials are molded through injection into a custom mold. In various embodiments, the housings and lock bars can be made by pressing or cutting, or even 3D printed using hot additive plasic materilas, silicone, castable polyurethane (CPU), Thermoplastic Elastomer (TPU, TPE), or alternate materials using a custom mold.

As described, the clasps include a lock bar that can achieved the lock of the housings in various matters. The lock bar can include connectors operable to hold and/or lock the mounting plate fastener into the eyelet of the shoe. The lock bar may include a shape such as an triangular bar, a round or rectangular bar, a cone, any other alternate shape designed for insertion into the groove, or an operable physical mechanism such as a clip or affixation mechanism. The lock bar may be composed at least partially of an elastomeric substance. The locking mechanism may be made of the same material as other parts of the clasp, partially of the material of the clasp, or a completely different material. The lock bar may also be co-molded or fitted to the housings with a different material than housings.

The lock bar may take on a variety of shapes. In some embodiments, critical factors determining these shapes include: an aesthetic appeal; an ability to be linked directly through the eyelet of a shoe; an ability to lock the shoe fit in place once the housings are pulled together. This is a subjective "feel" of the laces once inserted in the shoe and housings and locked and secured so fit form and function of the shoe clasp is obtained to the user's preference.

The lock bar may also be composed of a variety of materials that facilitate its function or add to its durability. The clasp may be composed of homogeneous material or composed in part of materials that are not elastic in order to allow the fastener to be more rigid, more durable, or more easily grabbed in particular locations. The clasp end may be altered such that the edges of the housings could be composed of plastic, metal or any other variety of materials that facilitate gripping. The object may be narrow enough to pass between the uppers (eyelets) of a shoe but wide enough to be grabbed and pulled. The lock bar may include a series of conjoined shapes such as a sphere or elliptical shape in addition to a triangle or "wing" shape that are combined to facilitate gripping and locking. The end may also have a hook, hole, slot, or other varying shapes that enables the fastener to lock onto a specific geometry included on the footwear, including but not limited to a D-ring, notch, hook, or the like.

Various embodiments include an elastomeric clasp capable of being customized to display an image or script on the surface of the clasp. The image or script may be placed on the clasp as an item or items on one individual clasp, or an item or items across the face of an individual clasp that in turn creates a larger image by the placing of all clasps together as a whole on the face of an article such as a shoe. The customization may include an indentation or printing on a surface of the clasp, a relief on the surface, projections above the surface, an opening entirely through the clasp, or printing and/or indentations on both sides of the clasp. The clasp may be composed of material having multiple colors either on one side of the fastener or on different sides of the fastener. The clasp may include a buckle, latch, or any variety of securing mechanism on the main body of the clasp. The buckle, latch, or any variety of securing mechanism may be functional or decorative.

In some embodiments, an image or script appearing on the clasp is determined by the manufacturer before retail sales of mounting plate fastener, or customized by the prospective buyer during retail sales, and is limited only by the size of the clasp. The clasp is optionally made from a material that is molded or stamped. A script or image may be added to the clasp surface by adding the mirror image of that script or image to the form of the mold or stamp. The script or image may be molded into the clasp at any depth including through the fastener material. Various dyes or inks and using adhering processes including but not limited to silk screening or sublimation printing may be used to print directly on the surface of the clasp. Printing on the clasp may occur on any surface of the fastener, comprising sides, top, bottom, ends, stamped/molded areas and the interior of the the clasp. Dyes or inks may be injected into the clasp to fill voids on the interior of the clasp created through the molding and/or stamping process. In some embodiments, the mounting plate fastener and the locking bar includes a surface that is easily writable and/or rewritable smooth surface on which a user can write their own text, autograph signing surfaces or draw their own individual personal images.

The clasp is optionally molded from a material that is made in a variety of colors. These colors may be mixed to create an unlimited variety of custom and/or random color patterns that appear as such on the clasp or sets thereof. The clasp may also be molded in such a way as to create the appearance that its top is one color and its bottom is a different color or that one side is one color and the other side is a different color. In addition, alternate visual elements may be molded into the clasp including but not limited to metallic flakes and opal essence. The transparency of the clasp can vary from completely opaque to transparent. In addition, the clasp may have a variety of transitions between transparent sections and opaque sections. These transitions may be random or predetermined for a desirable visual effect. Embodiments to include glow-in-the-dark, reflective materials for safety and for visual effects as well as black light reactive materials and colors for the same could be utilized.

Materials for the clasp housings and the lock could be made for numerous metals to help protect the foot, protect the laces and shield the tongue area of the shoe and ankle from hot embers in welding, grinding or in foundry situations where the boot and foot is most vulnerable. Metal would obviously add to the cost, weight and difficulty in manufacturing, but these could be outweighed by the requirement for user safety. Multiple metals could also be used as status symbols as metal plating and color schemes like gold or silver anodized aluminum could be more easily produced with metal injection molding or die casting and could be very popular with certain users.

The clasps are optionally constructed such that it appears to be attached to itself by some type of latch, buckle, snap, hook and eye, clip, or various other affixation devices. Adding these features to the clasp in this case is optionally purely decorative and added for aesthetic purposes. The clasps may also be constructed such that the affixation are functional instead of decorative. For example, mounting plate fasteners may be constructed in two parts, each part being set into the tongue of the shoe and only releasing one side of the laced ties. A fastening device such as a latch, buckle, snap, hook and eye, clip, hook-and-loop (aka VELCRO) or similar type attachment, or various other fastening devices may be located on the opposing ends that meet over the tongue of the shoe. The operation of the clasp is optionally similar to that of a buckle of a belt or the snap of a jacket. The clasp may be synched, buckled, snapped or fastened by any other means such that the lock bar of the clasp may be altered through the manipulation of the device where the two ends come together, via magnets instead of lock bar or pulling shoe lace ends or shoe lace body as and acting and functioning as the interfering the opposing mounting plate teeth and acting as the "lock bar."

The clasps may be inserted into the eyelets by hand or by machine when the shoes and boots are originally produced. In some embodiments, the clasp is attached to a shoe when the shoe is on a foot, but is preferably and more readily attached or partially attached to the shoe when the shoe is off the foot. In one method, the clasp may be held in one hand toward the base of the body exposing the housing. The shoe eyelet that is to be laced by user next is the other side of the housing is turned inward slightly and made visible to the user's eye. The end of clasp is gripped toward the end of the lock bar and laces are pulled taught and down and into the eyelet.

Once the lock bar has been placed into the slot and interferes with the housing separation/release, the two housings are joined together. The lock bar can be rotated, pushed and/or pulled out when desired to release clamp force and break the lace bond to the user's foot. Resistance created by wider or greater amounts of material toward the back of the lock bar may be a part of this process. Once the lock bar has been locked on the shoe with user's foot in the shoe string taughtness or resistance can be adjusted and undue pressure subsided, the lock bar will lock into place by interfering with the opposing teeth of the pins and the recesses on the housings at the wide area of the lock bar. This may be due in part to the larger volume of material of the lock bar pin at the top side of the locking mechanism or the configuration of such in alternate embodiments and due to user's force to press down on the lock bar. This also may be due to the dimensional taper in the body of the clasps grooves compared to the width of the lock bar at the tapered end.

These more than one materials are optionally co-molded and may include materials having different durometers. This embodiment also optionally includes co-molding of a variety of materials for different effect in locations other than the lock bar such as the curving transitional portion and/or of the body shape of the foot for wide, narrow and occasionally swollen feet.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A clasp comprising:

a first housing;

a first finger array of at least two housing fingers, integrally extending from said first housing, each of said fingers defining a first finger base supporting a first finger shoulder and a first finger wall defining a finger cavity therebetween;

a first recess array of at least one finger recess, between said first array of said housing fingers;

a second housing;

a second finger array of at least two housing fingers, integrally extending from said second housing, each of said fingers defining a second finger base supporting a second finger shoulder and a second finger wall defining a finger cavity therebetween;

a second recess array of at least one finger recess, between said second array of said housing fingers;

wherein upon joinder of said first housing to said second housing, said first array of said housing fingers are dimensioned to form a flush, longitudinal transition fit within said second array of said at least one finger recess; and said second array of said housing fingers are dimensioned to form a flush, longitudinal transition fit within said first array of said at least one finger recess;

wherein upon joinder of said first housing to said second housing, said finger cavities of said first finger array and said finger cavities of said second finger array aggregate to define a central longitudinal housing slot; and a lock bar adapted and dimensioned to form an axial interference fit within said housing slot.

2. The clasp of claim 1 wherein said first housing and said second housing both include perforations.

3. A kit of parts comprising the clasp of claim 2 further comprising a fastener having a cross section adapted to pass through said perforations.

4. A kit of parts comprising the clasp of claim 2 wherein said lock bar includes a lock bar aperture dimensioned to accept a fastener.

5. The kit of claim 4 further comprising at least two fasteners.

6. The clasp of claim 1 wherein said finger walls of both said first finger array and said second finger array include longitudinally-skewed dimensions.

7. The clasp of claim 6 wherein said finger walls of both said first finger array and said second finger array include longitudinally-skewed dimensions in opposite directions.

8. The clasp of claim 7 wherein said bases of both said first finger array and said second finger array include longitudinally skewed dimensions.

9. The clasp of claim 1 wherein upon joinder, said finger walls of said second array of said fingers and said shoulders of said first array of said fingers and said finger walls of said first array of said fingers and said shoulders of said second array of said fingers form said slot with flush sidewalls.

10. The clasp of claim 9 wherein upon joinder, said base of said second array of said fingers and said base of said first array of said fingers form said slot with a flush floor.

11. The clasp of claim 10 wherein upon joinder and application of said lock bar, said first housing and said first finger array and said second housing and said second finger array and said lock bar form a substantially solid clasp.

12. The clasp of claim 11 wherein upon joinder, said lock bar, said first housing, said first finger array, said second housing, and said second finger array form a substantially flush clasp roof.

13. The clasp of claim 12 wherein said lock bar includes a release protrusion.

14. The clasp of claim 13 wherein said lock bar and sidewalls of said slot include mating longitudinal track constituents adapted to permit the longitudinal insertion of said lock bar within said slot.

15. The clasp of claim 1 wherein said lock bar and sidewalls of said slot include mating longitudinal track constituents adapted to permit longitudinal insertion of said lock bar within said slot.

16. The clasp of claim 1 wherein said lock bar is affixed to at least one of said first housing and said second housing.

17. The clasp of claim 1 wherein said first housing and said second housing are both identical, complementary housings.

18. A clasp comprising:

a first housing;

a first finger array of at least two housing fingers, integrally extending from said first housing, each of said fingers defining a first skewed finger base supporting a first oppositely-skewed finger shoulder and a first oppositely-skewed finger wall defining a finger cavity therebetween;

a first recess array of at least one finger recess, between said first array of said housing fingers;

a second housing;

a second finger array of at least two housing fingers, integrally extending from said second housing, each of said fingers defining a second skewed finger base supporting a second oppositely-skewed finger shoulder and a second oppositely-skewed finger wall defining a finger cavity therebetween;

a second recess array of at least one finger recess, between said second array of said housing fingers;

wherein upon joinder of said first housing to said second housing, said first array of said housing fingers are dimensioned to form a flush, longitudinal transition fit within said second array of said at least one finger recess; and said second array of said housing fingers are dimensioned to form a flush, longitudinal transition fit within said first array of said at least one finger recess;

wherein upon joinder of said first housing to said second housing, said finger cavities of said first finger array and said finger cavities of said second finger array aggregate to define a central longitudinal housing slot; and a lock bar adapted and dimensioned to form an axial interference fit within said housing slot.

19. The clasp of claim 18 wherein said first housing and said second housing are both identical, complementary housings.

* * * * *